US005277405A

United States Patent [19]

McSwain

[11] Patent Number: 5,277,405

[45] Date of Patent: Jan. 11, 1994

[54] TEMPORARY DECKING SUPPORT

[76] Inventor: Gregory A. McSwain, 4448 Schmittwoods Ct., St. Louis, Mo. 63123

[21] Appl. No.: 983,787

[22] Filed: Nov. 30, 1992

[51] Int. Cl.[5] ..... B66F 3/08

[52] U.S. Cl. ..... 254/98

[58] Field of Search ..... 248/352, 354.1, 354.2, 248/354.3, 354.4, 354.5, 346; 254/45, 98, 101, 133 A, DIG. 4, DIG. 1

[56] References Cited

U.S. PATENT DOCUMENTS

| | | | |
|---|---|---|---|
| 1,176,489 | 3/1916 | Rosenfeld | 248/354.3 |
| 2,183,427 | 12/1939 | Hou | 248/352 |
| 2,196,715 | 4/1940 | Wiedman | 254/98 |
| 2,436,499 | 2/1948 | Williams | 248/354.5 |
| 2,991,579 | 7/1961 | Lies | 248/354.3 |
| 3,232,584 | 2/1966 | Miles | 248/352 |
| 3,313,505 | 4/1967 | Petrie | 248/354.5 |
| 3,437,296 | 4/1969 | Hinz | 248/354.5 |
| 4,014,517 | 3/1977 | Keagle | 248/352 |

FOREIGN PATENT DOCUMENTS

| | | | |
|---|---|---|---|
| 952356 | 11/1956 | Fed. Rep. of Germany | 254/98 |

*Primary Examiner*—Robert C. Watson

*Attorney, Agent, or Firm*—Paul M. Denk

[57] ABSTRACT

A temporary, self-leveling support device is provided having a screwjack body with a threaded hole formed centrally therein for engaging a threaded bolt. The bolt has a load bearing plate affixed thereon. The bolt can be rotated within the screwjack body to raise or lower the load bearing surface. The screwjack body has two opposed support legs pivotally attached thereto which extend down to form an A-frame support. The support legs have pivtotally mounted feet which can pivot to engage uneven surfaces thereby allowing the device to be self loading. The legs are secured to each other by an adjustable tie bar cross member which can be adjusted to increase or decrease the distance between the support legs and thereby adjust the overall height and base dimensions of the device.

2 Claims, 2 Drawing Sheets

TEMPORARY DECKING SUPPORT

BACKGROUND OF THE INVENTION

Bridge contractors who perform a stage construction removal or rehabilitation of a bridge deck must support the overhanging slab of concrete or decking when a portion of the slab or decking between the girder supports is removed. Furthermore, any existing slab or decking must still perform as a load carrying surface. Building contractors are required to support this section of overhanging or cantilevered concrete dead load at specified highway traffic load (maximum wheel load) carrying capacity. Traditionally these overhanging sections of concrete or decking were supported by means of large structural steel girders and cross frames. This type of support required extensive use of steel girders, was heavy and cumbersome, and labor intensive to install and remove. The present invention utilizes an adjustable, self-leveling load bearing A-frame to support the overhanging or cantilevered section of concrete or slab.

SUMMARY OF THE INVENTION

It is an object of the present invention to provide a temporary, easy to use, self-leveling device for supporting concrete slabs and bridge decking.

It is another object of the present invention to provide a temporary support device which provides for variable horizontal distance between the support legs by using a turnbuckle connector.

Another object of the invention is to provide a temporary support device that can be increased in height by adjusting the distance between the support legs by adjusting the turnbuckle.

A further object of the invention is to provide a support that has pivotable feet attached to pivotable support legs so that the legs can rest on uneven surfaces and thereby render the device self-leveling.

It is a further object of the invention to provide a temporary support device that can be increased and decreased in vertical height by adjusting a bolt extension through a threaded screwjack body.

A still further object of the invention is to provide a temporary support device that has a load bearing plate mounted to the threaded bolt.

A still further object of the invention is to provide a temporary support device that folds for storage and transportation.

Another object of the invention is to provide a temporary support which requires no additional tools or levelers or fasteners to prepare the support for use, is economical to manufacture and assemble, and well suited for its intended purpose.

Briefly stated, a temporary, self-leveling support device is provided having a screwjack body having a threaded hole formed centrally therein, a threaded bolt designed to engage said threaded hole and move upwardly and downwardly therein, a load bearing plate is mounted to the upper end of the bolt whereby the plate can engage the underside of the decking to be supported. A pair of opposed support legs are pivotally mounted to the screwjack body and a threaded, adjustable tie bar assembly pivotally mounted to and extending between the support legs. The tie bar assembly is adjustable whereby the distance between the support legs can be varied depending upon the desired height and support qualities of the device. The support legs can be made of any one of a number of materials such as steel, aluminum, wood, or a composite or laminate wood product. The support legs have pivotable feet attached thereto for engaging the ground or other surfaces. The pivotable feet combined with the pivotable support legs allow the legs to rest on uneven surfaces and thereby render the device self-leveling. The pivotal mounting of the legs and tie bar assembly allow the entire device to be folded for storage or transportation.

DESCRIPTION OF THE PREFERRED EMBODIMENT

Figure 1:
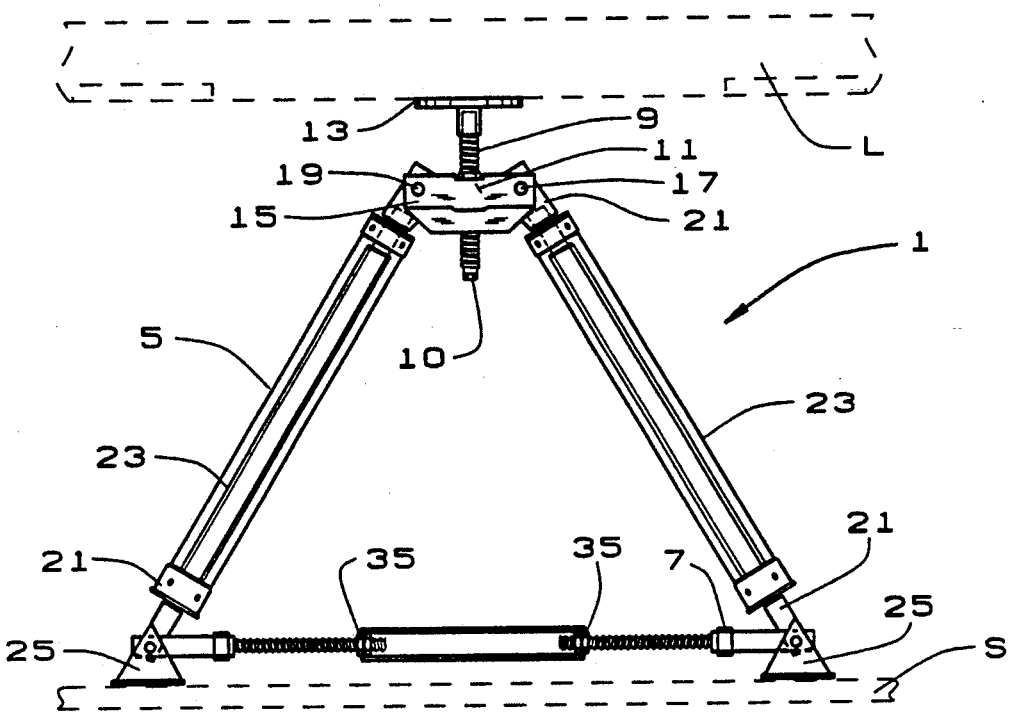
FIG. 1 is a front elevational view of the temporary support device in a fully assembled condition, the supported surface and resting surface shown in phantom to indicate environment.

The self-leveling, temporary support device of the present invention is shown generally at 1 in FIG. 1. Support device 1 is designed to rest on a surface S and support an overhanging section of bridge decking or slab or other heavy load as shown generally at L.

Support 1 is constructed of its various components and arranged in a triangle or A-frame design for versatility and strength. The device consists of three main groups of components including the screwjack, shown generally at 3, support legs 5, and the tension tie bar assembly shown generally at 7. The construction and function of each of the various components will be described in detail hereinafter.

The leveling screwjack 3 consists of a threaded bolt 9 and body 11. Bolt 9 passes vertically through a threaded hole (not shown) formed centrally in body 11. Bolt 9 can be rotated down into the body 11 to decrease the overall height of the device or may be rotated up to an extended position (FIG. 3) to increase the overall height of the device. Hex nut 10, formed on the lower end of bolt 9, allows for the application of a wrench or other tool so that the user can conveniently raise or lower bolt 9 within body 11.

A load bearing plate 13, which is attached to the upper end of bolt 9, is designed to engage the under surface of the decking slab or load L. It should be noted that bolt 9, body 11 and load bearing plate 13 may be made from any appropriate material, such as steel, and plate 13 and bolt 9 may be welded or appropriately attached together so that the leveling screw assembly can support a load without bending, breaking, or distortion of the respective threads.

Figure 2:
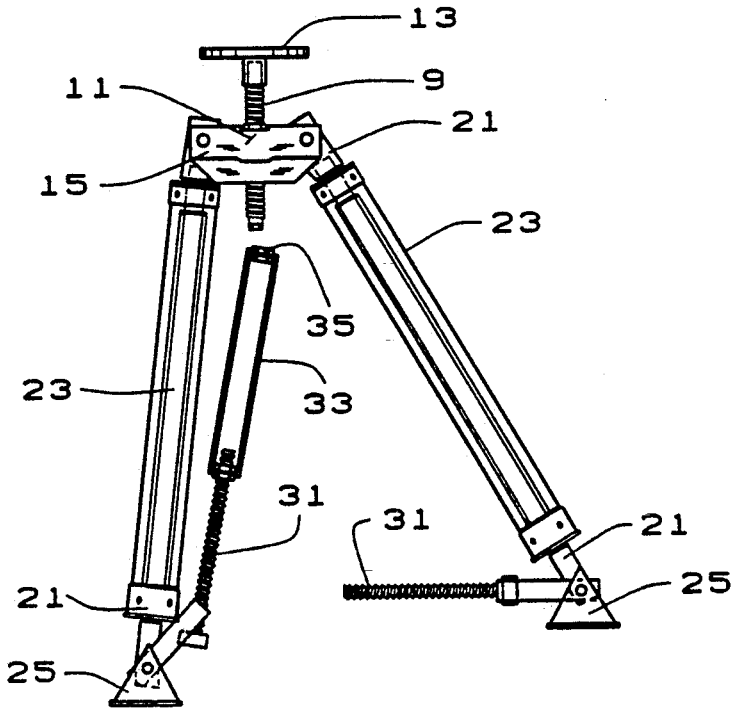
FIG. 2 is a front elevational view of the temporary support device in a partially disassembled, folded condition.

Screwjack body 11 has support ears 15 on each side thereof to accommodate the attachment of support legs as will be further explained. Holes 17 formed in ears 15 allow for the insertion of a bolt or a pivot pin 19 or other appropriate means of attachment. Leg support adapters 21 are attached to both the upper and lower ends of the legs 23. Support adapters 21 have a hollow body for the insertion of the end of leg 23. It should be noted that legs 23 can be made from any appropriate material such as wood, steel, aluminum, or composite or laminated wood product of appropriate weight bearing strength. Each adapter 21 attached on the top end of each leg 23 fits into the respective ear 15 and is held in place by pivot pin or bolt 19 allowing adapter 21, with leg 23 attached, to pivot therein. This configuration allows legs 23 to be moved closer to each or further away from each other to adjust the distance between the legs 23 and thereby adjust the overall height of the device and allow for proper positioning of the legs relative to each other on uneven terrain or on limited surface areas. Furthermore, the pivotal feature of the leg assembly allows the entire device to be folded up for transportion or storage as illustrated in FIG. 2.

Figure 3:
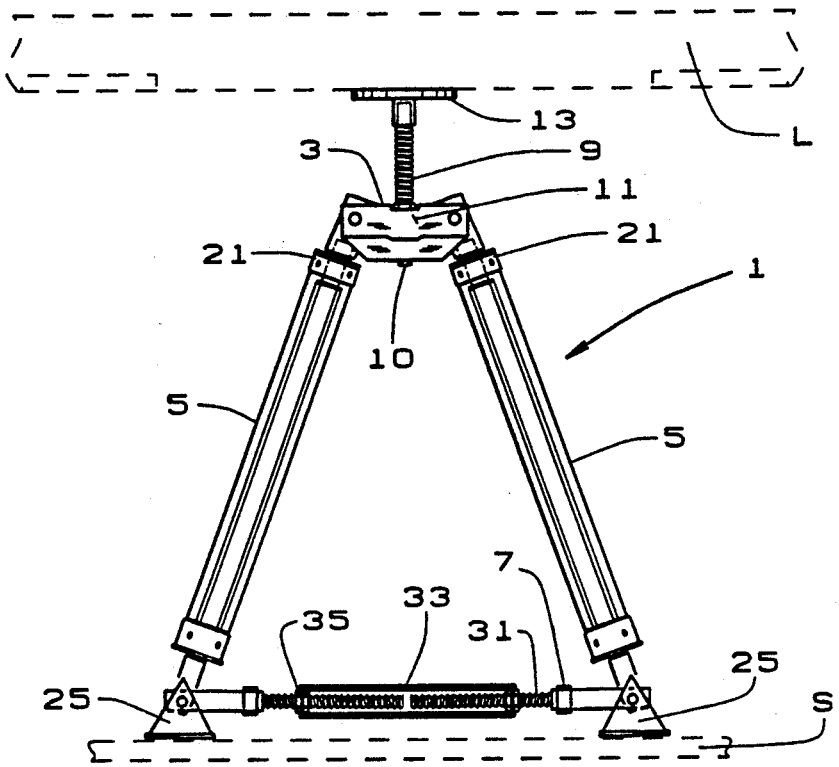
FIG. 3 is a front elevational view of the temporary support device in a fully elevated position.

FIG. 3 illustrates the device in a fully extended position wherein legs 23 are pivoted to a close position relative to each other and bolt 9 is rotated to a fully extended position thereby achieving a maximum distance between the bottom resting surface S and the load L.

Figure 4:
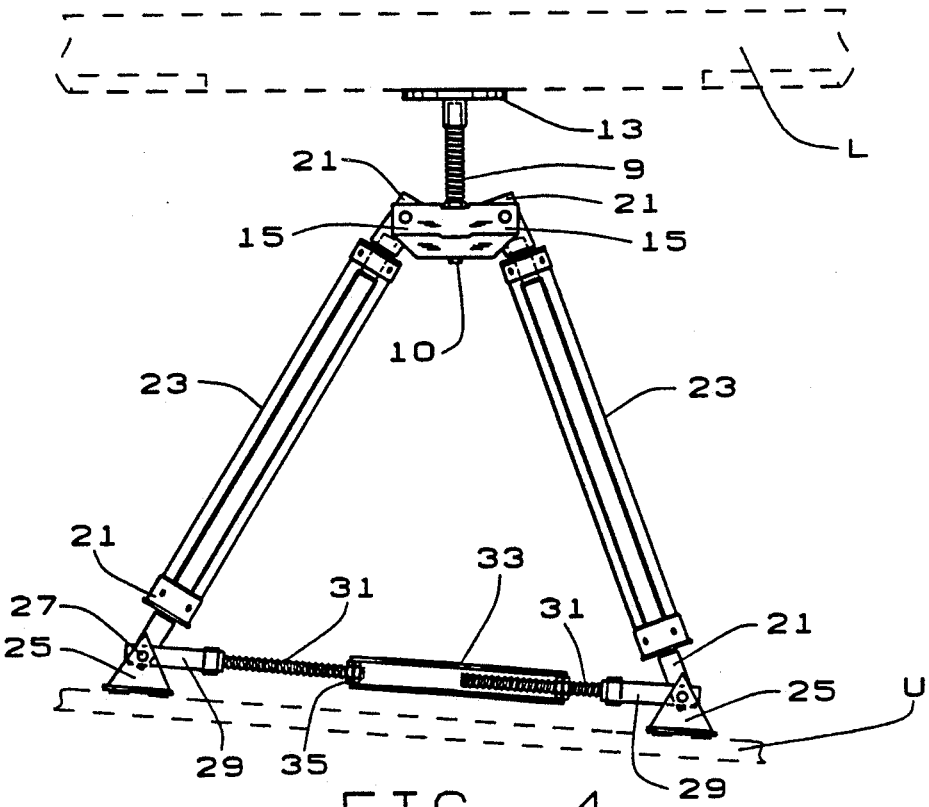
FIG. 4 is a front elevational view of the temporary support device, resting on an uneven surface illustrating the self-leveling features of the device.

The leg adapters 21 on the lower ends of legs 23 are pivotally mounted to base feet 25 with pivot pins or bolts 27. This pivotable foot assembly as well as the pivotable attachment of the adapter 21 in ears 15 allow the entire device to be self-leveling. FIG. 4 illustrates the self-leveling features of the present invention. Feet 25 are resting on an uneven surface U. Feet 25 pivot on adapter 21 to accommodate the uneven surface and adapters 21 pivot within ears 15 to maintain the load bearing plate 13 and in an essentially horizontal and useful position under load L. It should be noted that the surface-engaging bottom of feet 25 (not shown) can have nail holes or screw holes to accommodate the attachment of a larger surface engaging plates to increase the resting surface-engaging area of feet 25 when feet 25 are placed on soft ground, gravel, or other similar surface conditions that require a larger foot 25.

Turning now to the tension tie bar assembly 7 which is designed to keep leg 23 in their desired useful position relative to each other. The tie bar assembly comprises the pivoting feet 25, a pair of opposed tension rod connectors 29, a pair of threaded tension rods 31 which engage and rotate into the tension rod connectors 29, and a threaded turnbuckle 33 having threaded hex nut connectors 35 formed on each end of turnbuckle 33 to engage each of the threaded tension rods 31. The user can apply a wrench or other tool to threaded hex nut 35 and rotate turnbuckle 33 drawing threaded tension rods 31 into turnbuckle 33 to draw legs 23 toward each other to lessen the distance between legs 23 and increase the overall height of the entire device. FIG. 3 illustrates the tie bar assembly with threaded rods 31 fully rotated into turnbuckle 33. Obviously, to increase the distance between legs 23, the user can apply a wrench or other tool to the hex nuts 35 and rotate turnbuckle 33 in the opposite direction thereby causing threaded rods 31 to rotate out of turnbuckle 33 to increase the distance between legs 23 so as to lower the overall height of the device as well as change the overall dimensions and affect the stability of the assembly.

Tie bar assembly 7 serves to join the legs 23 and keep them in place in a useful configuration. Furthermore, the tie bar assembly completes the strong triangular configuration of the device and adds to the overall strength and load bearing capacity of the assembly. Also, as shown in FIG. 2, the tie bar assembly can be disengaged to allow the device to be folded up for transportation and storage.

As changes and modifications obvious to one skilled in the art can be made without departing from the scope of the invention the foregoing description and drawings of the device are intended to be illustrative and not to be construed in a limiting sense.

What is claimed:

1. A self-leveling support device for supporting bridge decking and the like comprising:

a screwjack assembly;

a weight bearing surface on said screwjack assembly;

a pair of opposed support support legs;

means for pivotally mounting said legs to said screwjack assembly;

means for adjustably securing said support legs in a useful, supportive configuration, said means comprising an adjustable tie bar base assembly attached between and connecting said legs;

pivotal base means on each said leg for engaging a resting surface thereby rendering the device self-leveling; and each side tie bar base assembly further comprises a first and a second swivel foot, each said swivel foot being attached to an opposing support leg, a first tension rod connector pivotally mounted to said first swivel foot, a second tension rod connector pivotally mounted to said second swivel foot, each said first and second tension rod connectors having a threaded hole formed therein, a first threaded tension rod designed to engage said threaded hole in said first tension rod connector, a second threaded tension rod designed to engage said threaded hole in said second tension rod connector, and a threaded turnbuckle tension means for engaging both said first and second threaded tension rods whereby said turnbuckle can be rotated to engage said tension rods to increase or decrease the distance between each said leg.

2. A self-leveling support device for supporting bridge decking and the like comprising:

a screwjack assembly;

a weight bearing surface on said screwjack assembly;

a pair of opposed surface legs;

means for pivotally mounting said legs to said screwjack assembly;

means for adjustably securing said support legs in a useful, supportive configuration;

said screwjack assembly further comprises a screwjack body having a threaded opening formed therein and a threaded bolt passing through and engaging said threaded opening;

means for pivotally mounting said legs to said screwjack assembly further comprises a pair of support ears, said support ears integrally formed on said screwjack assembly, said support ears having pivot holes formed therein for the insertion of a pivot means, said pivot means being insertable through said holes and through a leg adaptor having a hole formed therein and affixed to said support leg, pivotable base means on each said leg for engaging a resting surface thereby rendering the device self-leveling; and said weight bearing surface further comprises a load carrying plate mounted on said bolt.

* * * * *

UNITED STATES PATENT AND TRADEMARK OFFICE

CERTIFICATE OF CORRECTION

PATENT NO. : 5,277,405

DATED : January 11, 1994

INVENTOR(S) : Gregory A. McSwain

It is certified that error appears in the above-indentified patent and that said Letters Patent is hereby corrected as shown below:

Column 4, claim 2, line 44, change "surface" to --support--.

Signed and Sealed this

Thirty-first Day of May, 1994

Bruce Lehman

*Attest:*

BRUCE LEHMAN

*Attesting Officer*

*Commissioner of Patents and Trademarks*